United States Patent [19]

Mathieu

[11] 4,264,015

[45] Apr. 28, 1981

[54] RAILWAY COUPLER WEAR MEMBER

[75] Inventor: Julien C. Mathieu, Waynesville, N.C.

[73] Assignee: Dayco Corporation, Dayton, Ohio

[21] Appl. No.: 26,478

[22] Filed: Apr. 2, 1979

[51] Int. Cl.[3] ..... B61G 5/00; B61G 9/20; F16C 27/02

[52] U.S. Cl. ..... 213/61; 105/225; 105/420; 213/21; 213/51; 308/3 R; 308/238; 308/244

[58] Field of Search ..... 105/225, 199 C, 420; 213/61, 63, 65, 21, 51; 308/238, 3 R, 244

[56] References Cited

U.S. PATENT DOCUMENTS

| | | | |
|---|---|---|---|
| 609,178 | 8/1898 | Bagshawe | 105/225 |
| 3,554,618 | 1/1971 | Ditzler et al. | 308/238 X |
| 4,001,124 | 1/1977 | Hussey | 105/225 |
| 4,133,434 | 1/1979 | Chierici | 213/61 |
| 4,188,888 | 2/1980 | Cooper et al. | 105/199 C |
| 4,238,039 | 12/1980 | Cooper | 213/61 |

*Primary Examiner*—David M. Mitchell
*Assistant Examiner*—Howard Beltran
*Attorney, Agent, or Firm*—Charles E. Bricker

[57] ABSTRACT

A wear member is provided wherein such wear member is used between relatively movable components of a railway vehicle and wherein the wear member comprises a main body made primarily of a polymeric material, a support for the main body with the support having opposed surface portions, and a plurality of openings in the support having integral rivet-like portions of the polymeric main body corresponding in number and configuration to the plurality of openings extending therethrough and holding the main body to the support with such polymeric main body having parts thereof disposed in embracing relation around the opposed surface portions.

14 Claims, 4 Drawing Figures

RAILWAY COUPLER WEAR MEMBER

BACKGROUND OF THE INVENTION

1. Field of the Invention

This invention relates to railway vehicle structure and in particular to a wear member for use between a pair of relatively movable components of such structure.

2. Prior Art Statement

It is known in the art to provide a wear member supported by at least one of a pair of relatively movable components of a railway vehicle for the purpose of protecting the components from wear. However, heretofore it has been common practice to provide a wear member made either entirely of a hard metal or entirely of a hard polymeric material and such wear member is suitably supported in position between such components and once the wear member becomes excessively worn it is removed and a new one installed in its position. However, metal wear members are usally made of comparatively expensive metallic materials and do not have optimum antifriction properties while wear members made entirely of polymeric material have comparatively poor structural strength and thus are often easily broken requiring frequent replacement.

It has also been proposed heretofore to provide so-called wear members or liners for center plate structure of a railway vehicle with reinforcing material embedded therein as disclosed in U.S. Pat. No. 4,188,888; however, such liners have minimum structural strength and in use are confined between associated supporting surfaces.

Further, it has been proposed in U.S. Pat. No. 3,554,618 to provide a wear member in the form of a pedestal liner which has a substantially unsupported insert or plastic wear plate.

It has also been proposed in U.S. patent application Ser. No. 27,340, now U.S. Pat. No. 4,238,039, issued Dec. 9, 1980, to provide a wear member comprising a support having a continuous planar supporting surface, a polymeric material, and means attaching the polymeric material to the support and supporting same against the continuous supporting surface for the purpose of providing a substantially structurally self supporting wear member.

SUMMARY

It is a feature of this invention to provide in a railway vehicle having a pair of relatively movable components and a wear member carried by one of the components and protecting the components from wear during relative movement thereof, the improvement wherein the wear member comprises a main body made primarily of a polymeric material and having an antifriction wear surface engageable by the other component, support means for the main body with the support means having opposed surface portions, and a plurality of openings in the support means having integral rivet-like portions of the polymeric main body corresponding in number and configuration to the plurality of openings extending therethrough and holding the main body to the support means.

Another feature of this invention is to provide a wear member of the character mentioned in which the polymeric main body has parts thereof disposed in embracing relation around the opposed surface portions whereby the wear member is substantially structurally self supporting yet comparatively inexpensive.

Another feature of this invention is to provide a wear member of the character mentioned in which the wear member is a coupler carrier wear member carried by an associated coupler carrier and particularly adapted to be engaged by a coupler assembly of a railway vehicle.

Another feature of this invention is to provide a wear member of the character mentioned in which the main body has reinforcing means embedded therein with the polymeric material surrounding the reinforcing means and serving as a matrix therefor.

Another feature of this invention is to provide a wear member of the character mentioned in which the support means comprises a plurality of L-shaped members each having a pair of legs disposed in perpendicular relation with at least one leg of each L-shaped member having a plurality of openings therein and having polymeric material extending therethrough and self-holding same to its L-shaped member.

Another feature of this invention is to provide a wear member of the character mentioned in which the polymeric material is an ultra high molecular weight material.

Another feature of this invention is to provide a wear member of the character mentioned in which the ultra high molecular weight material is polyethylene.

Another feature of this invention is to provide an improved method of making a wear member of the character mentioned for use between relatively movable components of a railway vehicle.

Therefore, it is an object of this invention to provide an improved wear member and method of making same having one or more of the novel features set forth above or hereinafter shown or described.

Other details, features, uses, objects, and advantages of this invention will become apparent from the embodiments thereof presented in the following specification, claims, and drawing.

BRIEF DESCRIPTION OF THE DRAWING

The accompanying drawing shows a present preferred embodiment of this invention, in which.

DESCRIPTION OF ILLUSTRATED EMBODIMENT

Figure 1:
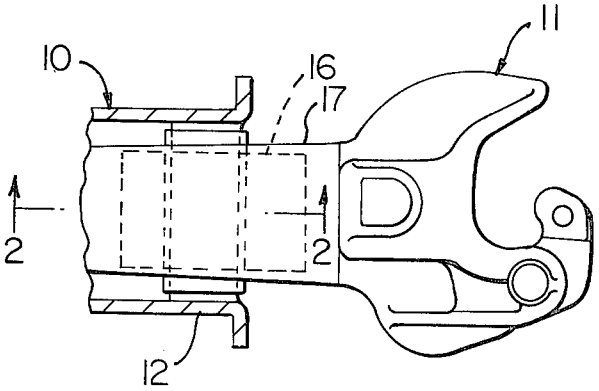
FIG. 1 is a fragmentary top plan view of an end portion of a freight car showing a coupling arrangement thereof comprising a coupler assembly and a coupler carrier.
Figure 2:
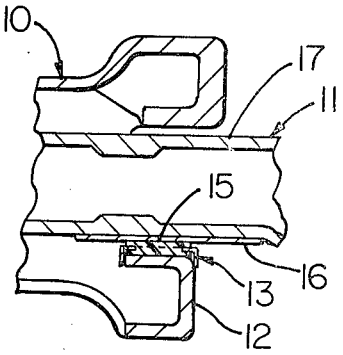
FIG. 2 is a fragmentary cross-sectional view taken essentially on the line 2—2 of FIG. 1.

Reference is now made to FIGS. 1 and 2 of the drawing which illustrate a fragmentary portion of an end portion of a railway vehicle which is designated generally by the reference numeral 10. The railway vehicle 10 comprises a pair of relatively movable components which in this example are shown as a railway coupler assembly 11 and a coupler carrier 12. The coupler carrier 12 supports and has attached thereto, by any suitable means, a structurally self-supporting coupler carrier wear member of this invention which is designated generally by the reference numeral 13 and such member 13 protects the coupler assembly 11 and coupler carrier 12 from wear during relative movement thereof.

Figure 3:
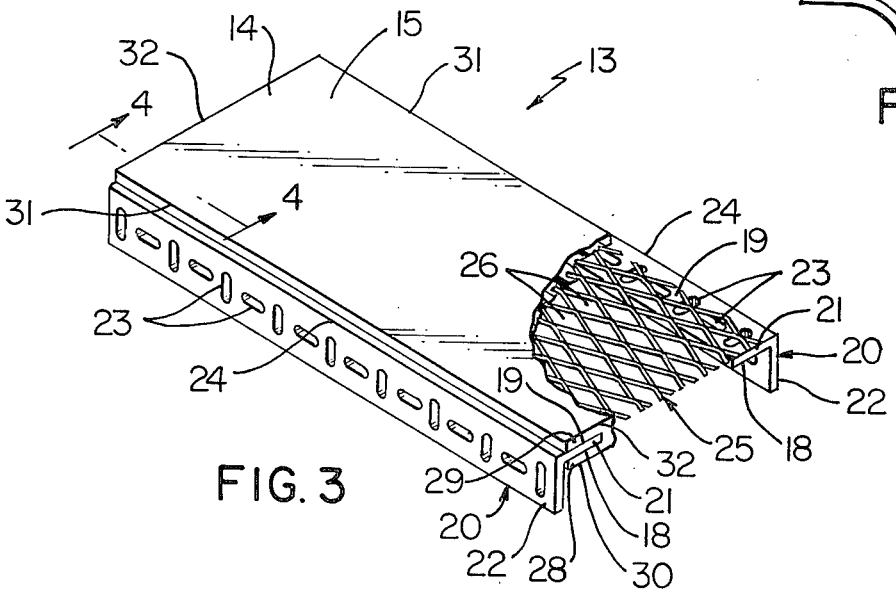
FIG. 3 is a perspective view with parts broken away of a coupler carrier wear member of this invention used in the coupling arrangement of FIG. 1.

The coupler carrier wear member 13 is best illustrated in FIG. 3 and comprises a main body 14 made primarily of a polymeric material and has an antifriction wear surface 15 which in this example is shown as the top surface thereof. The surface 15 is engageable by the coupler assembly 11 and in particular by a component plate member 16 fixed to a shank portion 17 of the coupler assembly 11.

The wear member 13 comprises support means for the main body 14 and in this example such support means is in the form of a pair of spaced supports shown as substantially L-shaped brackets or members each designated by the same reference numeral 20. Each member 20 has opposed parallel surface portions 18 and 19 which will be further described subsequently.

Each L-shaped support or member 20 is a single-piece member and has a pair of legs 21 and 22 disposed in perpendicular relation to each other and adjoined on a common bight or interconnection 24. Each L-shaped member 20 has opening means in each of the legs 21 and 22 comprising a plurality of openings in the form of elongate openings each designated by the same reference numeral 23. In this example of the invention the surface portions 18 and 19 referred to above are on each leg 21 and each opening 23 in each leg 21 extends through its associated surface portions 18 and 19.

The openings 23 in each leg 21 of support or member 20 have integral rivet-like portions 27 of the polymeric main body 14 corresponding in number and configuration to said plurality of openings 23 extending therethrough whereby the integral rivet-like portions 27 hold the main body to the spaced supports 20. The polymeric main body has integral parts 28 and 29 thereof disposed in embracing relation around the opposed parallel surface portions 18 and 19 respectively of each leg 21 whereby the outer side portion of each leg 21 is sandwiched between parts 28–29.

The openings 23 are of substantially equal size and each is defined in cross section by a pair of rectilinear sides and semicircular ends. Each opening 23 defines a rivet-like portion of substantial length which is at least twice its width.

The elongate openings 23 in each leg 21 and 22 are disposed so that immediately adjacent openings along the length of a leg are disposed with their elongate dimensions substantially perpendicular to each other. Accordingly, the openings 23 in each leg are disposed in two sets in which one set consists of alternate openings disposed with their elongate dimensions extending roughly along a common axis, and another set consists of alternate openings disposed with their elongate dimensions in spaced parallel relation and perpendicular to such common axis of the first set.

Figure 4:
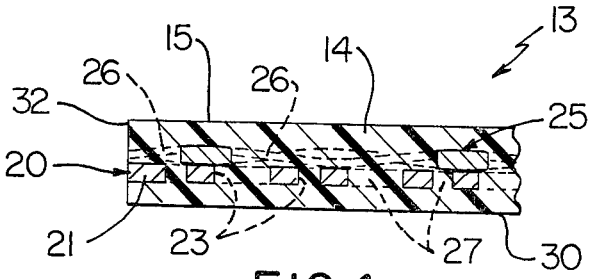
FIG. 4 is a fragmentary cross-sectional view taken essentially on the line 4—4 of FIG. 3.

The polymeric material 14 extends through the openings 23 as shown in FIG. 4 and the polymeric material of the main body 14, rivets 27, and embracing parts 28 and 29 is a single-piece structure which is, in essence, self-held to the L-shaped support members 20.

As previously mentioned the main body 14 is made primarily of a polymeric material which is preferably in the form of a synthetic plastic material as indicated by cross-hatching in the drawing and the polymeric material preferably has reinforcing means embedded therein with such reinforcing means in this example being designated generally by the reference numeral 25. The reinforcing means 25 may be any suitable structure and in this example is shown as an expanded metal structure having a grid-like pattern of diamond shaped outline and having apertures 26 extending therethrough defined by the various grids. The expanded metal structure may be of any suitable type known in the art and is preferably an expanded ferrous metal structure. The polymeric material 14 is provided such that it serves as a matrix for and substantially completely surrounds the reinforcing expanded metal structure 25.

The reinforcing means or metal structure 25 has been shown and described herein as being an expanded metal structure; however, it will be appreciated that such metal structure may be in the form of a wire mesh, a plate or like structure having suitable apertures therein, a corrugated structure with suitable apertures, and the like. However, it will be appreciated that the reinforcing means need not necessarily be provided in the wear member 13.

In making the wear member 13 the L-shaped members 20 are suitably supported within an associated die structure or mold device so that the leg portions 22 thereof extend outwardly of the mold device. The mold device has walls defining the top surface 15 as well as the bottom surface 30 of the main body 14. The mold device also has suitable walls defining the opposite side edge portions 31 of the main body 14 and opposite end edge portions 32 of such main body.

In this manner it will be appreciated that with the L-shaped supports 20 being suitably supported and with the mold device defining surfaces 15 and 30, side edge portions 31, and end portions 32 polymeric material may be introduced into the mold device and subjected to controlled heat and pressure as is known in the art to thereby define the single-piece main body 14 with or without the reinforcing structure 25 embedded therein and consisting of integral components in the form of polymeric rivets 27 and embracing parts 28 and 29. Accordingly, the polymeric material or main body 14 is self-held to the L-shaped support members 20 and as highlighted in FIG. 5.

The polymeric material 14 may be any suitable polymeric material known in the art; however, a suitable ultra high (at least two million) molecular weight material is preferably employed. The more specific preferred material is polyethylene having a molecular weight within the range of four to six million.

The L-shaped members 20 may be made of any suitable material known in the art and preferably such members are made of metallic material. It will also be appreciated that suitable means in the form of locating guide means, or the like, may be provided on one or both of the members 20 to enable supporting of the member 13 in the desired manner on the coupler carrier 12.

Regarding the reference to use of ultra high molecular weight material such as polyethylene it is to be understood that the preferred technique for determining this molecular weight is referred to as the intrinsic viscosity test and is widely used in the United States.

Reference has been made in this disclosure of the invention to the forming of wear member 13 in an associated die structure or mold device using polymeric material to define the main body 14. The polymeric material may be provided in powder, flake, or pellet form and is heated under controlled temperatures and pressures in its associated mold device with the L-shaped supports 20 suitably supported in such mold device to define a molten state for such polymeric material. In the case of ultra high molecular weight polyethylene having a molecular weight in the range of four to six million such material may be formed or molded at temperatures ranging between 250° and 450° F., at pressures ranging between 500 to 2,000 psi, and with the molding action being achieved within time periods of three minutes to thirty minutes. After the molding action is achieved the mold device containing the polymeric main body 14 with its integral rivets 27, embracing parts 28–29, and L-shaped supports 20 is suitably cooled using ambient air or a liquid spray or both to solidify the polymeric material while tenaciously fixing such material to the supports 20 to thereby complete the wear member 13.

It will also be appreciated that molten polymeric material may be introduced from a suitable extruder into the mold device as is known in the art and similarly cooled.

While present exemplary embodiments of this invention, and methods of practicing the same, have been illustrated and described, it will be recognized that this invention may be otherwise variously embodied and practiced within the scope of the following claims.

What is claimed is:

1. In a wear member for a railway vehicle wherein said vehicle comprises a pair of relatively movable components and said wear member is supported by one of said components and protects said components from wear during relative movement thereof, the improvement wherein said wear member comprises, a main body made primarily of a polymeric material and having an antifriction wear surface engageable by said other component, support means for said main body, said support means having opposed surface portions, a plurality of openings extending completely through said support means, said polymeric main body having integral parts thereof disposed in embracing relation around said opposed surface portions and completely concealing said openings, and a plurality of rivet-like portions of said polymeric main body corresponding in number and configuration to said plurality of openings, said rivet-like portions extending between the embracing parts as an integral part thereof and through said plurality of openings to hold said main body to said support means.

2. A wear member as set forth in claim 1 in which said support means comprises at least one L-shaped member having a pair of legs, said plurality of openings being provided in at least one leg thereof, and said opposed surface portions being provided along an outer portion of said one leg.

3. A wear member as set forth in claim 1 in which said support means comprises a pair of L-shaped members disposed in parallel relation on opposite sides of said main body, each L-shaped member having a pair of legs disposed substantially perpendicular to each other, said plurality of openings being provided in at least one of said legs of each L-shaped member, said opposed surface portions being provided along an outer portion of each of said legs, said polymeric main body having associated parts thereof disposed in embracing relation around opposed surface portions of each of said legs and completely concealing the associated openings therein, and said plurality of rivet-like portions comprising integral rivet-like portions extending between embracing parts associated with each of said one legs of each L-shaped member and through associated openings in each of said one legs.

4. A wear member as set forth in claim 3 in which the other of said legs of each L-shaped member also has a plurality of openings therein.

5. A wear member as set forth in claim 3 in which said openings in each of said one legs are elongate openings of substantially equal size disposed in two sets, one of said sets being defined by alternating openings having their elongate dimensions disposed along a common axis, and the other of said sets being defined by alternating openings having their elongate dimensions disposed in spaced parallel relation.

6. A wear member as set forth in claim 3 in which said polymeric material comprises ultra high molecular weight polyethylene.

7. A wear member as set forth in claim 6 in which said polyethylene has a molecular weight of at least two million.

8. A wear member as set forth in claim 6 in which said polyethylene has a molecular weight within the range of four to six million.

9. In a coupler carrier wear member for a railway vehicle wherein said vehicle comprises a coupler assembly and a coupler carrier which are relatively movable and said coupler carrier wear member is carried by said coupler carrier and protects said coupler assembly and coupler carrier from wear during relative movement thereof, the improvement wherein said wear member comprises, a main body made primarily of a polymeric material and having an antifriction wear surface engageable by said coupler assembly, a pair of spaced supports for said main body with each support having opposed parallel surface portions, a plurality of openings in each support with each opening extending completely through its associated opposed parallel surface portions, said polymeric main body having integral parts thereof disposed in embracing relation around each of said associated opposed surface portions and completely concealing associated openings therethrough, a plurality of rivet-like portions of said polymeric main body corresponding in number and configuration to said plurality of openings, each of said rivet-like portions extending between associated embracing parts as an integral part thereof and through an associated opening, said rivet-like portions holding said main body to said spaced supports.

10. A wear member as set forth in claim 9 in which each of said supports is a metal support member.

11. A wear member as set forth in claim 9 in which each of said supports is an L-shaped member having a pair of legs disposed substantially perpendicular to each other, said plurality of openings being provided in at least one of said legs of each L-shaped member, and said opposed surface portions being provided along an outer portion of each of said one legs.

12. A wear member as set forth in claim 11 in which said openings in each of said one legs are elongate openings of substantially equal size defined in cross section by a pair of rectilinear sides and semicircular ends each opening defining a rivet-like portion of substantial length.

13. A wear member as set forth in claim 12 in which said parts of said main body in embracing relation are of roughly rectangular outline.

14. A wear member as set forth in claim 13 in which said polymeric material comprises ultra high molecular weight polyethylene having a molecular weight within the range of four to six million.

* * * * *